US011598332B2

(12) United States Patent
Franzoni et al.

(10) Patent No.: US 11,598,332 B2
(45) Date of Patent: Mar. 7, 2023

(54) HYDRAULIC ORBITAL MACHINE AND METHOD FOR ADJUSTING AN ORBITAL MACHINE

(71) Applicant: Dana Motion Systems Italia S.R.L., Reggio Emilia (IT)

(72) Inventors: Federica Franzoni, Reggio Emilia (IT); Alessandro Sassi, Reggio Emilia (IT)

(73) Assignee: Dana Motion Systems Italia S.R.L., Reggio Emilia (IT)

( * ) Notice: Subject to any disclaimer, the term of this patent is extended or adjusted under 35 U.S.C. 154(b) by 30 days.

(21) Appl. No.: 17/272,198

(22) PCT Filed: Sep. 2, 2019

(86) PCT No.: PCT/IB2019/057374
§ 371 (c)(1),
(2) Date: Feb. 26, 2021

(87) PCT Pub. No.: WO2020/044320
PCT Pub. Date: May 3, 2020

(65) Prior Publication Data

US 2021/0317830 A1 Oct. 14, 2021

(30) Foreign Application Priority Data

Aug. 31, 2018 (IT) ..... 102018000008269

(51) Int. Cl.
*F03C 2/00* (2006.01)
*F03C 4/00* (2006.01)
(Continued)

(52) U.S. Cl.
CPC ..... *F04C 2/104* (2013.01); *F03C 2/30* (2013.01); *F04C 2/084* (2013.01);
(Continued)

(58) Field of Classification Search
CPC ..... F04C 2/084; F04C 2/104; F04C 15/0065; F04C 2240/10; F04C 2240/20; F04C 2240/30; F04C 2240/60; F03C 3/20
See application file for complete search history.

(56) References Cited

U.S. PATENT DOCUMENTS 6,126,420 A * 10/2000 Eisenmann ..... F04C 14/10 418/19
2005/0238521 A1* 10/2005 Nordborg ..... F03C 2/08 418/61.3

(Continued)

FOREIGN PATENT DOCUMENTS

EP 0124299 A2 11/1984
GB 1178893 A 1/1970

OTHER PUBLICATIONS

ISA European Patent Office, International Search Repod Issued in Application No. PCT/IB2019/057374, dated Nov. 4, 2019, WIPO, 2 pages.

(Continued)

*Primary Examiner* — Theresa Trieu
(74) *Attorney, Agent, or Firm* — McCoy Russell LLP

(57) ABSTRACT

Provided is a hydraulic orbital machine and a method of adjusting a hydraulic orbital machine comprising a first and a second lobed disk which rotate eccentrically about a rotation axis and within respective rotors; the machine is characterized by the fact that it has adjustment means designed to mutually angularly offset the angles at which, when the machine is at a standstill, the chambers defined between the lobed disks and the stator have minimum volume.

13 Claims, 10 Drawing Sheets

(51) Int. Cl.

| | |
|---|---|
| ***F04C 11/00*** | (2006.01) |
| ***F04C 2/00*** | (2006.01) |
| ***F04C 2/10*** | (2006.01) |
| ***F03C 2/30*** | (2006.01) |
| ***F04C 2/08*** | (2006.01) |
| ***F04C 15/00*** | (2006.01) |

(52) U.S. Cl.
CPC ..... *F04C 15/0065* (2013.01); *F04C 2240/10* (2013.01); *F04C 2240/30* (2013.01); *F04C 2240/60* (2013.01)

(56) References Cited

U.S. PATENT DOCUMENTS

2008/0075617 A1* 3/2008 Miller ..... F04C 2/103 418/61.3
2013/0149181 A1* 6/2013 Jingzhi ..... F04C 2/103 418/166

OTHER PUBLICATIONS

ISA European Patent Office, Written Opinion of the International Searching Authority Issued in Application No. PCT/B2019/057374, dated Nov. 4, 2019, WIPO, 5 pages.

* cited by examiner

HYDRAULIC ORBITAL MACHINE AND METHOD FOR ADJUSTING AN ORBITAL MACHINE

CROSS-REFERENCE TO RELATED APPLICATIONS

The present application is a U.S. National Phase of International Patent Application Serial No. PCT/IB2019/057374, entitled "IMPROVED HYDRAULIC ORBITAL MACHINE AND METHOD FOR ADJUSTING AN ORBITAL MACHINE," and filed on Sep. 2, 2019. International Patent Application Serial No. PCT/IB2019/057374 claims priority to Italian Patent Application No. 102018000008269, filed on Aug. 31, 2018. The entire contents of each of the above-mentioned applications are hereby incorporated by reference in their entirety for all purposes.

TECHNICAL FIELD

The present invention concerns a hydraulic orbital machine, such as a hydraulic orbital engine or a hydraulic pump and a method for adjusting a hydraulic orbital machine.

BACKGROUND AND SUMMARY

Briefly, hydraulic orbital machines generally include a stator case with contoured internal walls inside of which a lobed member is housed and moves, which rotates eccentrically relative to a central rotation axis, so that during the eccentric rotation, variable volume chambers are created between the lobed member and the contoured walls of the case, into which a hydraulic liquid, for example oil, is introduced or from which a hydraulic liquid is discharged. Generally, depending on how the stator case (and possibly the lobed member) is made, these machines fall into two types, "gerotor" and "roller gerotor" or more simply "rotor". The present invention applies indifferently to both types of orbital machine.

If the machine is an orbital engine, the hydraulic energy (pressure, oil flow) is converted into mechanical energy (shaft torque and speed), whereas if the machine is a pump, the mechanical energy (shaft torque and speed) is converted into hydraulic energy (pressure, oil flow). Focusing for the sake of simplicity on orbital engines, the oil is introduced into the variable volume chambers and discharged therefrom by a distributor member, which opens and closes the passages for the oil leading to the chambers.

A known limitation of these machines is the displacement, which is established by the geometries and by the dimensions of the lobed member and the stator case in which it rotates. This factor means that orbital machines are not very versatile, because they are not suited to management of the shaft rotation speed and torque, thus for many applications of the engine (or, more generally, of the machine) a correctly sized machine must be chosen. Said limitation is often remedied by providing appropriate circuit systems, often dissipative and in any case complex, or by adopting axial units which, however, have the drawback of rotating at higher rotation speeds and therefore must be connected to reduction systems (e.g. reducer) with an overall increase in the costs and complexity of the assembly.

To remedy these limitations, solutions having a plurality of inlets and/or outlets have also been developed so that, briefly, the same orbital engine can be made to operate with two different displacements: one maximum and one minimum. These solutions, although able to increase flexibility compared to a traditional orbital engine, with fixed displacement, are not fully satisfactory due to the fact that there is no real variability of the displacement, but only a switching from a maximum displacement to a minimum displacement and vice versa; considerable limitations therefore remain in terms of machine versatility. The same occurs, briefly, when the machine is used or configured to operate as a pump.

The purpose of the present invention is to provide a hydraulic orbital machine, such as a hydraulic orbital engine or a hydraulic pump, and/or an adjustment method for a hydraulic orbital machine that is able to improve the known art in one or more of the aspects described above. In the context of said purpose, one object of the invention is to make available a hydraulic orbital machine, such as a hydraulic orbital engine or a hydraulic pump or a method for adjusting a hydraulic orbital machine that is versatile.

A further object of the invention is to make available a hydraulic orbital machine or a method for adjusting a hydraulic orbital machine that allows a progressive variation in displacement. Furthermore, the present invention has the object of overcoming the drawbacks of the known art, providing an alternative to the existing solutions. Last but not least, a further object of the invention is to provide a hydraulic orbital machine or a method for adjusting a hydraulic orbital machine which is highly reliable and relatively easy to produce at competitive costs.

This aim, in addition to these and other objects that will become clearer below, are achieved by a hydraulic orbital machine with a first stator case portion which delimits a first internal contoured volume, a first lobed disk configured to rotate eccentrically about a rotation axis (X) in the first stator case portion so as to form with the latter a plurality of first chambers which have a volume that varies in the rotation of the first lobed disk, at least one of the first chambers having a minimum volume at a first angle of the first stator case portion. In some aspects, the hydraulic orbital machine may additionally include a second stator case portion, which delimits a second internal contoured volume, at least one second lobed disk configured to rotate together with the first lobed disk eccentrically about the rotation axis in the second stator case portion so as to form with the latter a plurality of second chambers having a volume that varies in the rotation of the second lobed disk, at least one of the second chambers having a minimum volume at a second angle of the second stator case portion. The hydraulic orbital machine may additionally include an adjustment means designed to mutually angularly offset the first and second angles.

BRIEF DESCRIPTION OF THE FIGURES

Further characteristics and advantages of the invention will become clearer from the description of an embodiment of the hydraulic orbital machine according to the invention, illustrated, by way of non-limiting example, in the accompanying drawings, in which.

Figure 1:
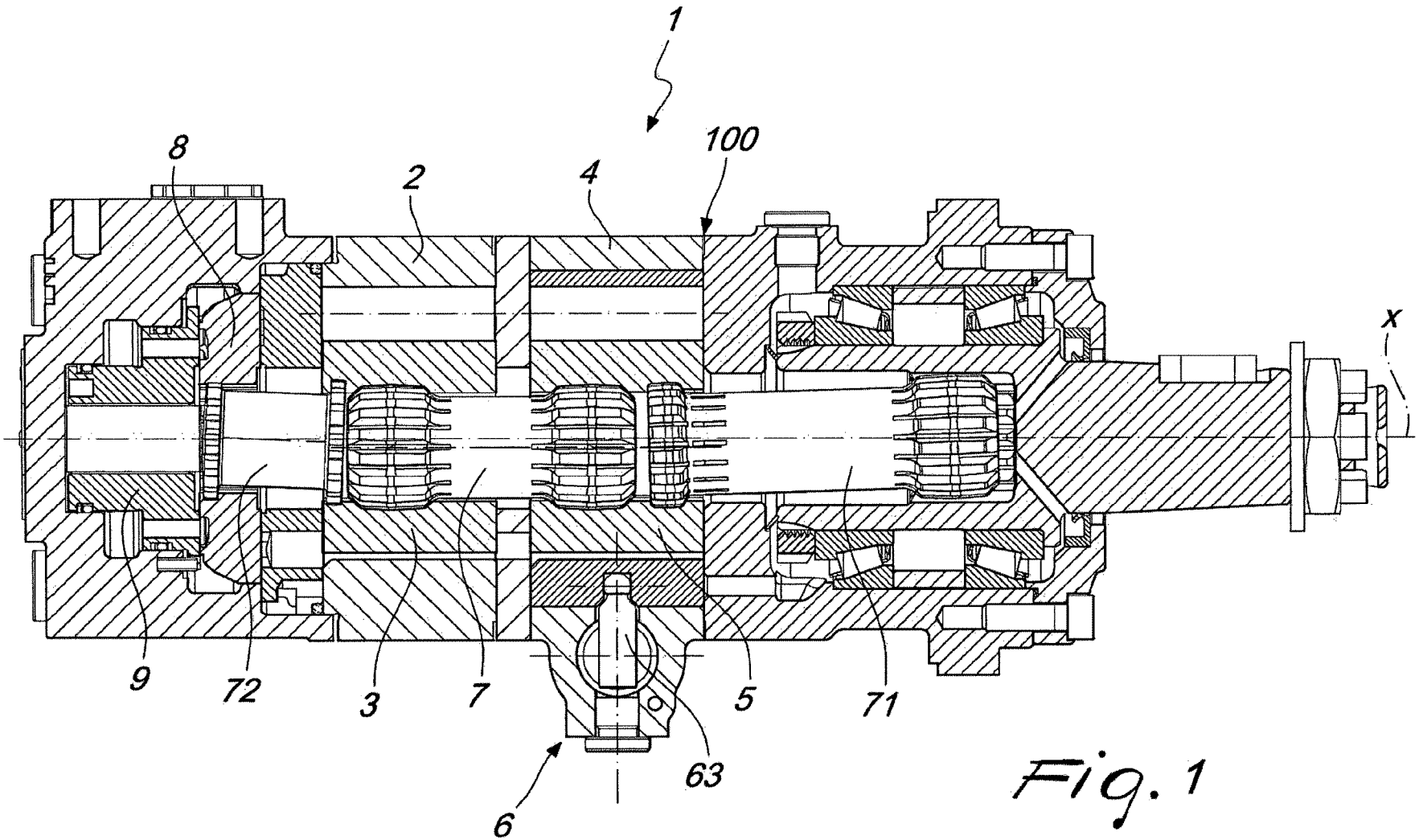
FIG. 1 illustrates a longitudinal section view of a machine according to an embodiment.
Figure 2:
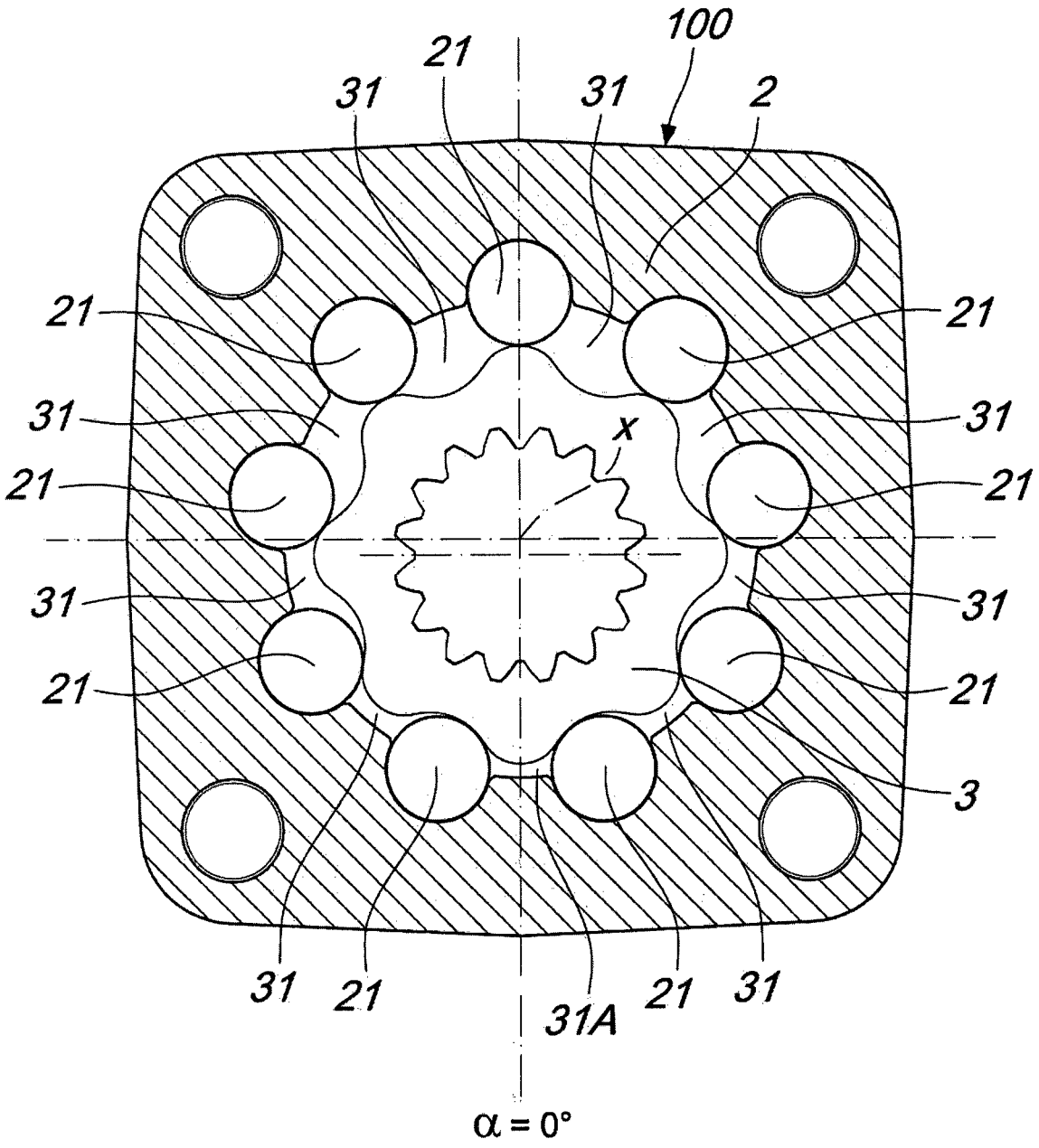
FIG. 2 illustrates a first cross-section of the machine of the preceding FIG. 1.

With reference to the figures cited, the hydraulic orbital machine according to the invention is indicated overall by the reference number 1.

In particular, the figures show a preferred non-limiting embodiment, in which the hydraulic machine is an engine and has a rotor configuration.

DETAILED DESCRIPTION

The hydraulic orbital machine 1 comprises a first stator case portion 2 which delimits a first internal contoured volume, and a first lobed disk 3 configured to rotate eccentrically in the first stator case portion 2. In this way, the first lobed disk 3 defines with the first stator case portion 2 a plurality of first chambers 31. During the eccentric rotation of the first lobed disk 3, the chambers 31 have a variable volume, from a minimum volume (chamber 31A in the figure) to a maximum volume. With the machine at a standstill, as in the figures, the chamber 31A at minimum volume is arranged at a first angle of the first stator case portion 2 measuring it, for example, with respect to a central axis at an angle $\alpha=0°$.

According to the invention, the machine 1 comprises a second stator case portion 4 which delimits a second internal contoured volume. A second lobed disk 5 is housed in the contoured volume of the second case portion 4 and is configured to rotate eccentrically, together with the first lobed disk 3, in the second stator case portion 4. Similarly to the first lobed disk, the second lobed disk 5 defines with the second stator case portion 4 a plurality of second chambers 51, the volume of which varies during the eccentric rotation of the second lobed disk 5, in operation. Also in this case, one of said second chambers 51A has a minimum volume at a given second angle of the second stator case portion 4, when the machine is at a standstill.

During operation, both the first and the second lobed disk rotate eccentrically about a same common rotation axis X. Both the first and the second stator case portion 2, 4 are accommodated inside an external enclosure 100 of the machine 1. For both the lobed disks 3, 5, given the eccentricity of their rotation in the respective stator case portion 2, 4, of the chambers 31, 51 which form between the lobed disk 3, 5 and the relative stator case portion 2, 4, one chamber 31A, 51A has a minimum volume, or a volume below that of the other chambers of the same lobed disk 3, 5. Each minimum volume chamber 31A and 51A is therefore in the same angular position when the respective lobed disk 3 or 5 has accomplished a complete rotation of 360°.

According to the disclosure the machine 1 comprises adjustment means 6 designed to mutually angularly offset the minimum volume chambers 31A, 51A; in other words, the minimum volume chambers are not mutually axially aligned, but offset by a certain angle measured around the axis X. In this way it is possible to operate the machine 1 as if it were a machine having a progressive displacement variation. The angular offset between the minimum volume chambers 31A, 51A can be obtained in two different ways: either by rotating the two lobed disks 3, 5 about the rotation axis X one with respect to the other or, advantageously more simply, by rotating the stator case portions 2, 4 about the rotation axis X one with respect to the other. In the embodiment illustrated, this second solution is used.

Each chamber 31 of the lobed disk 3 is in fluid communication with a respective chamber 51 of the lobed disk 3. The pair of chambers 31, 51 in fluid communication defines a "compartment" of the machine. Therefore, if each lobed disk 3, 5 has nine chambers, there will be nine pairs of chambers 31, 51 and, consequently, nine machine "compartments".

Each compartment of the machine 1 communicates with a high- or low-pressure hydraulic fluid source of the machine 1. During the rotation, each compartment alternates arcs of rotation in which the chambers 31, 51 (of the same pair forming the same compartment) are in communication with the high-pressure fluid source and arcs of rotation in which they are in communication with the low-pressure fluid source. This operation is guaranteed by a distributor assembly 8,9 which will be described in further detail below.

In general, the adjustment means 6 are connected to at least one between the first or the second stator case portion 2, 4; more in particular, in the embodiment illustrated, the adjustment means 6 are kinematically coupled to the second stator case portion 4, which is able to rotate relative to the first stator case portion 2. In particular, both the stator cases 2 and 4 may be accommodated inside the same enclosure of the machine 1, and at least one of the two (in the example, the second portion 4) is rotatable about the rotation axis X of the lobed disks 3, 5 relative to the other or relative to the enclosure. In this way, operating the adjustment means 6 results in an angular offset of the minimum volume chambers 31A, 51A about the rotation axis X of the lobed disks 3, 5.

Figure 3:
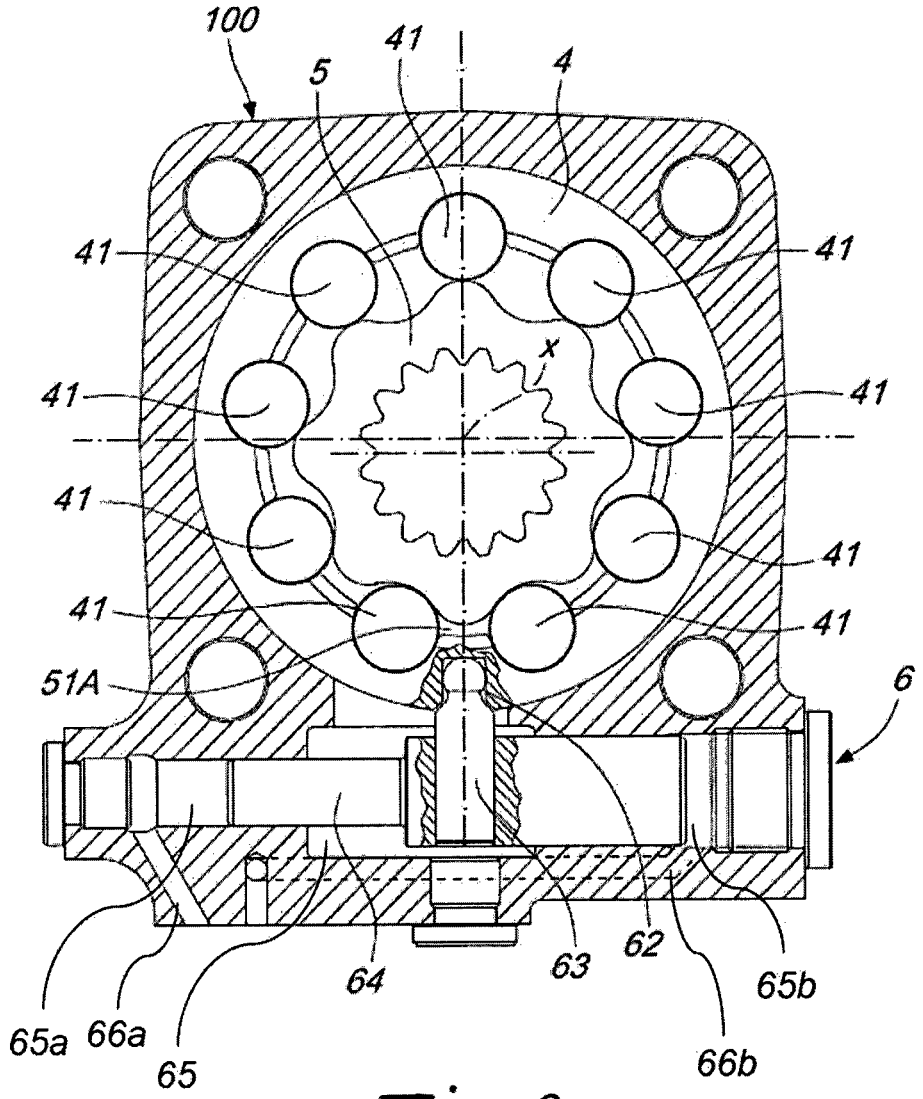
FIG. 3 illustrates a second cross-section of the machine of the preceding FIG. 1 in a first operating configuration.
Figure 4:
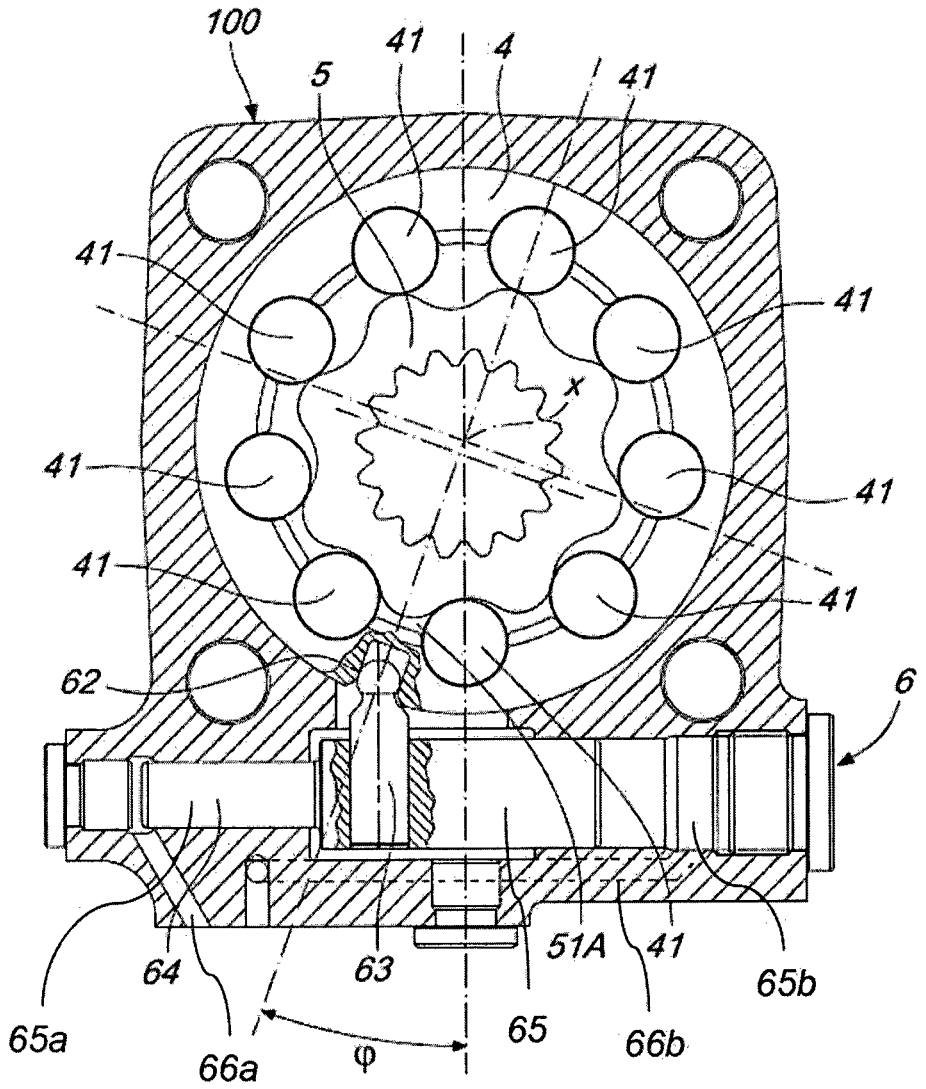
FIG. 4 illustrates a longitudinal section corresponding to that of the preceding FIG. 1.
Figure 5:
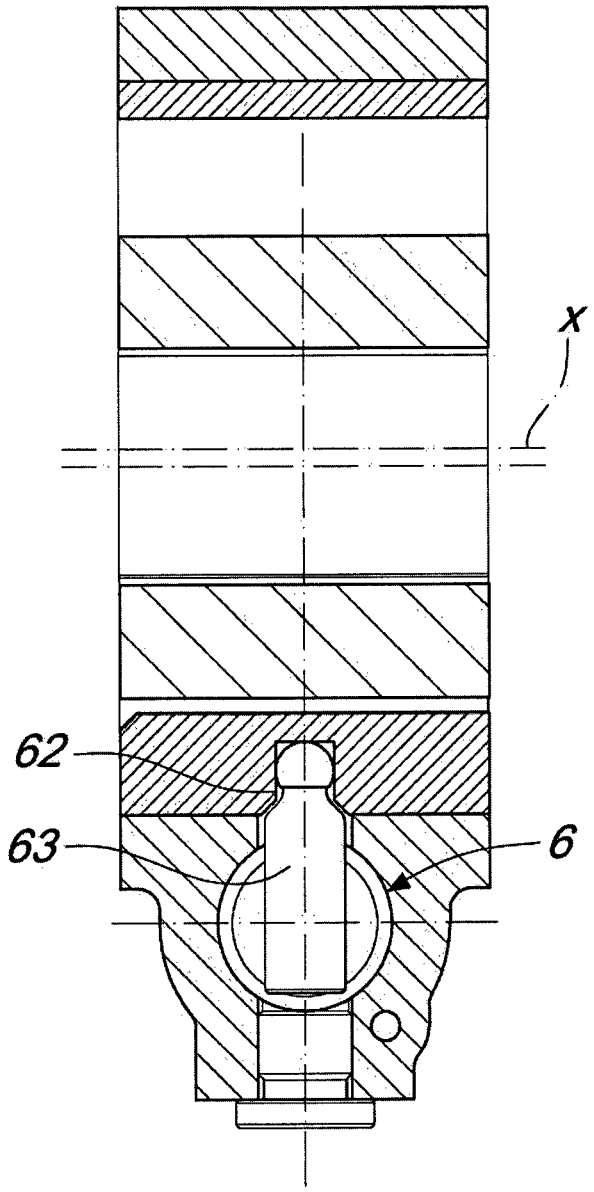
FIG. 5 illustrates the second cross-section corresponding to that of FIG. 3 in a second operating configuration.

In alternative embodiments of the hydraulic machine 1 not explicitly shown here, both the first stator case portion 2 and the second stator case portion 4 can be rotatably mounted inside the enclosure 100. In this case, both the first stator case portion 2 and the second stator case portion 4 are configured so that they can rotate relative to the enclosure 100 about the rotation axis X. For example, (also) the first stator case portion can be made like the second stator case portion shown in FIGS. 3 and 4. Consequently, the chambers of each pair of chambers 31, 51 forming a machine compartment can be angularly offset by a certain angle about the axis X, so that the chambers 31, 51 of the same pair (compartment) are not mutually aligned in the direction of the axis X.

Each lobed disk/stator case portion pair 2,3 and 4,5 effectively forms an independent engine unit (when the machine 1 is an engine, and analogously when it is a pump) and may be connected to the same internal distribution, common for each lobed disk/stator case portion pair 2, 3 and 4, 5. The angular offset determines in practice an offset of the dead centres of each lobed disk/stator case portion pair 2,3 and 4,5, creating a sort of internal by-pass which allows progressive variation of the behaviour of the machine 1, making it similar to the behaviour of a machine with progressively variable displacement. In fact, since the two chambers of the same pair that create a compartment are connected to the same hydraulic fluid source (with high or low pressure), during operation, due to the offset, one chamber, e.g. 31, will increase in volume, while the other chamber of the same pair, e.g. 51, will drop in volume, even though it is connected to the same pressurized fluid source, for example the high pressure source. The offset just described can theoretically result in annulment of the displacement, and it is therefore possible to cover the entire displacement variation range. The practical effects of the angular offset deriving from the adjustment are shown in the graphs of FIGS. 6A-D in four different cases, corresponding to as many values of the offset angle (indicated by φ) and in the case exemplified of a lobed disk 3, 5 with eight lobes cooperating with a roller type case portion, among which nine chambers 31, 51 are identified.

In particular, in the embodiment of the hydraulic machine 1 described here, the second stator case portion 4 can be rotatably mounted inside the enclosure 100; in this way the adjustment means 6 are configured in such a way that they can rotate the second stator case portion 4 relative to the enclosure 100 by an angle φ with $\varphi \geq 360°/(2 \cdot N) = 360° (2 \cdot 9) = 20°$, where N=9 is the number of rolling bodies 41 of the second stator case portion 4 cooperating with the lobed disk 5. In this way, the adjustment means 6 can vary the phase between the first chambers 31 that periodically vary their volume, provided between the second stator case portion 4 and the lobed disk 5 that rotates eccentrically, and the second chambers 51 that periodically vary their volume, provided between the first stator case portion 2 and the lobed disk 3 that rotates eccentrically, by at least half of the period, with respect to each other. For example, in the embodiment of the hydraulic machine 1 shown here, the external face of the second stator case portion 4 facing the enclosure 100 and the internal face of the enclosure 100 facing the second stator case portion 4 have a complementary shape throughout the entire circumference of the first stator case portion 2.

The offset angle φ is measured between homologous points of the two chambers 31, 51 of a same pair forming a compartment: for example, at the centre-line point between the rolling bodies. The graphs show the (ideal) trend of the non-dimensionalized flow rate inside a single compartment of the machine 1 as a function of the offset between the two lobed disks 3, 5. In particular the graphs with broken lines (thick Q3 and thin Q5) indicate the non-dimensionalized real flow rates of the single chambers 31, 51 of the two disk/stator complexes 2,3 and 4,5 which are aligned along a same machine compartment, while the continuous line Qut shows the overall working flow rate of the machine compartment.

Figure 6A:
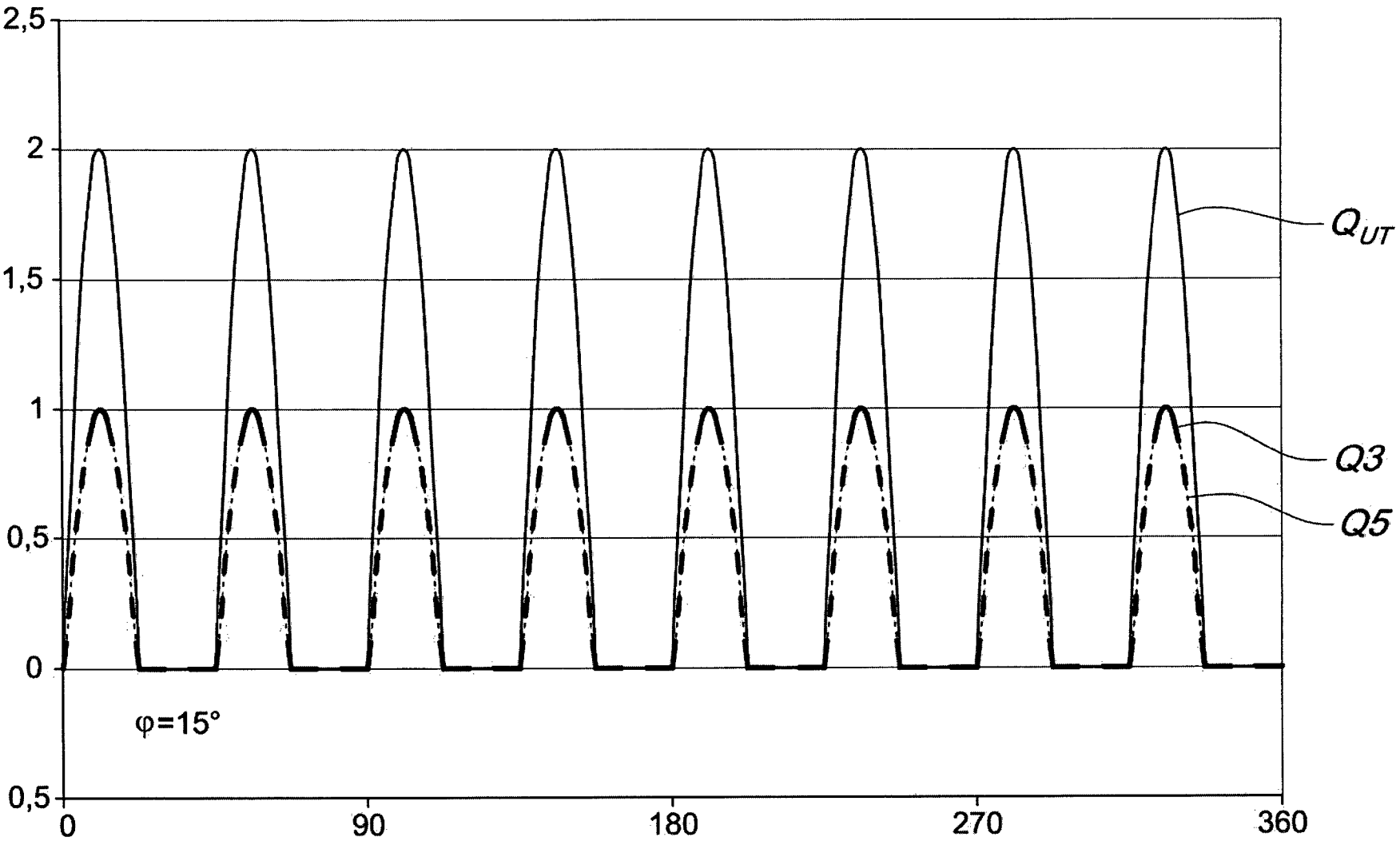
FIGS. 6A-6D illustrate graphs of the flow rate of the machine of the preceding figures, in different operating configurations.
Figure 6B:
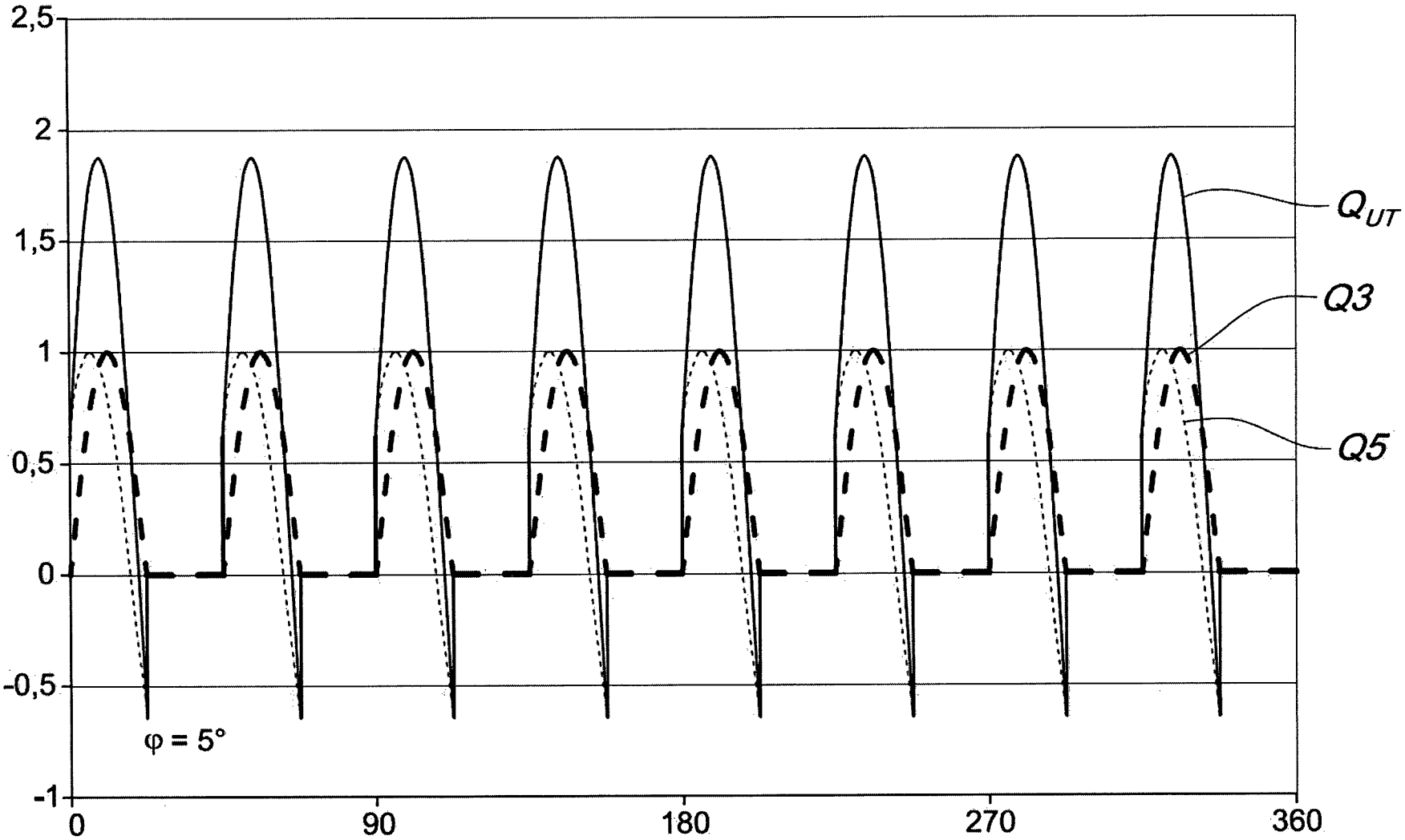
Figure 6C:
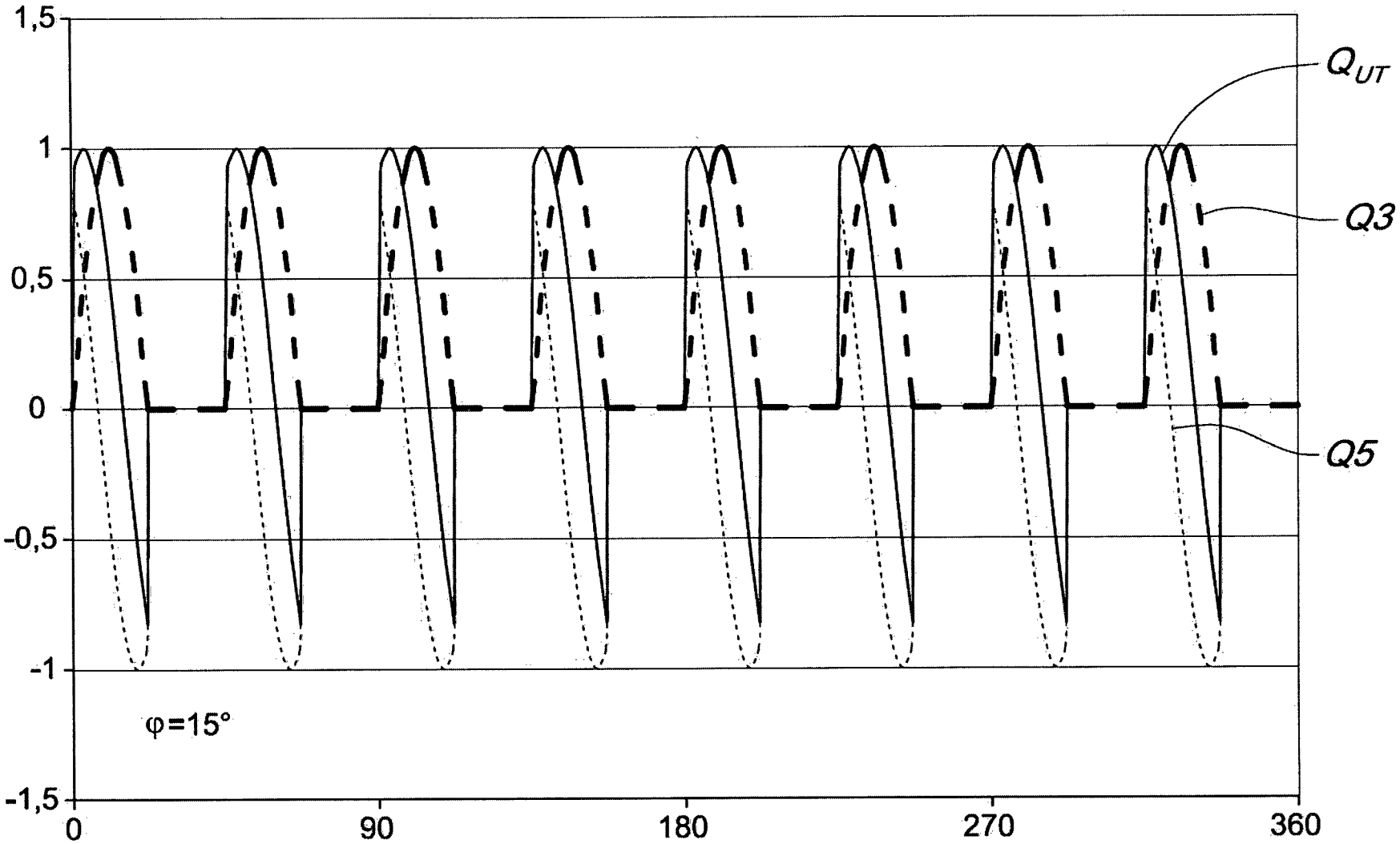
Figure 6D:
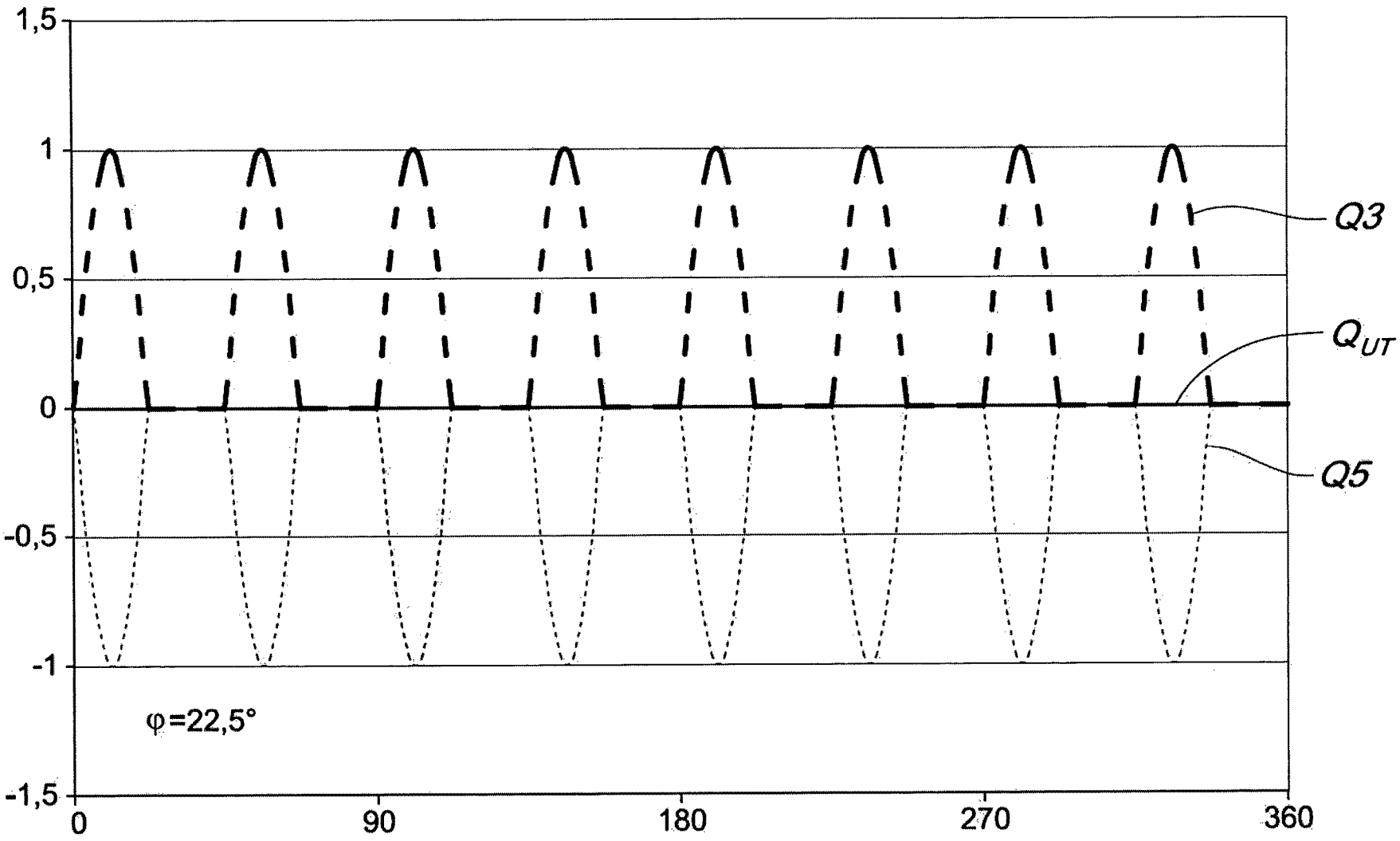

The working flow rate Qut shown in FIGS. 6A-D is the flow rate that carries out work (if the machine is an engine) or receives work (if the machine is a pump): therefore when, as in the case of FIG. 6D, the flow rate shown by the continuous line is equal to zero, it does not mean, in practice, that the chambers 31, 51 are not crossed by hydraulic fluid, but that the work produced (or absorbed) by the machine 1 is that of an engine (pump) that processes the fluid flow rate illustrated: in the case of FIG. 6D, therefore, a nil flow rate means that the machine is not producing (or absorbing) work relative to the external environment.

"Displacement" here indicates the maximum volume processed for each revolution: the displacement is a geometric and constructive characteristic of the machine and theoretically, for a pump, coincides with the volume of fluid transferred per revolution from the low-pressure environment to the environment with higher pressure. Vice versa, for an engine, the displacement coincides with the volume of fluid transferred per revolution from the high-pressure environment to the lower pressure environment.

In particular, if the offset is nil (case φ=0°, FIG. 6A), the chambers 31 and 51 of a same pair are aligned on a longitudinal plane containing the axis X, and the total flow rate Qut is exactly equal to the sum of the flow rates Q3 and Q5 and is equivalent to the flow rate that would be obtained if there were one single lobed disk/stator case portion pair with height equal to the sum of the heights of the two lobed disk/stator case portion pairs 2,3 and 4,5.

At the beginning of offset determination (cases φ=5° and φ=15° of FIGS. 6B and 6C), one of the two chambers of a same pair defining a compartment, for example the chamber 51 in the example, is not longitudinally aligned with the other chamber of the pair 31. The flow rate Qut of the compartment is therefore below the maximum since in some phases a lobed disk/stator case portion pair 2,3 or 4,5 is in suction and the other sends fluid to the same source and vice versa.

When the offset is such as to completely oppose the two lobed disk/stator case portion pairs 2,3 and 4,5 (case φ=22.5° of FIG. 6D), the total working flow rate Qut is nil. This means that, due to the invention, it is possible to obtain an extremely versatile displacement/transmission control, in which the machine behaves as if it were following a progressive displacement trend; in particular on applications of the machine 1 (as an engine) with high power and low torque it is possible to avoid the inclusion of reducers to reduce the rotation speeds, which would otherwise be obligatory if traditional machines were adopted.

Going back to the adjustment means 6, in the illustrated embodiment they comprise first actuation shaft 64 which linearly moves a pivot 63 which engages in a seat 62 of the second stator case portion 4, which is mounted rotatable in the enclosure 100 of the machine 1. The adjustment means 6 include a hydraulic cylinder 65. The hydraulic cylinder is arranged inside or integrated in the enclosure 100 of the hydraulic machine 1. The hydraulic cylinder 65 includes a piston portion which is formed integrally or connected with the first actuation shaft 64. The hydraulic cylinder further includes a first actuation chamber 65*a* and a second actuation chamber 65*b*. The actuation chambers 65*a* and 65*b* are in fluid communication with the control lines 66*a* and 66*b* respectively. The first actuation shaft 64 can be actuated by varying the hydraulic pressure in the actuation chambers 65*a* and 65*b* through the control lines 66*a* and 66*b*. The movement of the first actuation shaft 64 determines the linear shift of the pivot 63 which in turn determines rotation of the second stator case portion 4 about the rotation axis X, in the enclosure 100, and, in the last analysis, the angular offset discussed above. The first actuation shaft 64 is configured so that it moves in a plane perpendicular to the rotation axis X. In other embodiments not explicitly shown here, the first actuation shaft 64 can be configured to move so that at least one of its components moves in a plane perpendicular to the rotation axis X.

In the above cited alternative embodiment in which both the first stator case portion 2 and the second stator case portion 4 are configured so as to rotate relatively inside of the enclosure 100 about the rotation axis X, the adjustment means 6 can be connected both to the first stator case portion 2 and to the second stator case portion 4. For example, the adjustment means 6 can additionally include a second hydraulic cylinder and a second actuation shaft to actuate also the first stator case portion. In this case the adjustment means 6 may be configured in order to independently actuate the first stator case portion 2 and the second stator case portion 4. It is clear that in the alternative embodiment not explicitly shown here, the adjustment means can include actuation means which are not necessarily hydraulic. For example, the adjustment means 6 could furthermore include at least one or more electric motors for rotating one or both of the stator case portions 2,4 relative to the enclosure 100.

Going on now to examine other optional details of the embodiment of the machine 1, it can be noted in the attached figures that the first and the second lobed disk 3, 5 are coupled to a same shaft 7 which in turn is coupled by rotation to an outlet shaft 71 which extends outside of the enclosure 100; on the opposite side, the shaft 7 is connected to a support shaft 72 which in turn is coupled to the enclosure 100.

Figure 7:
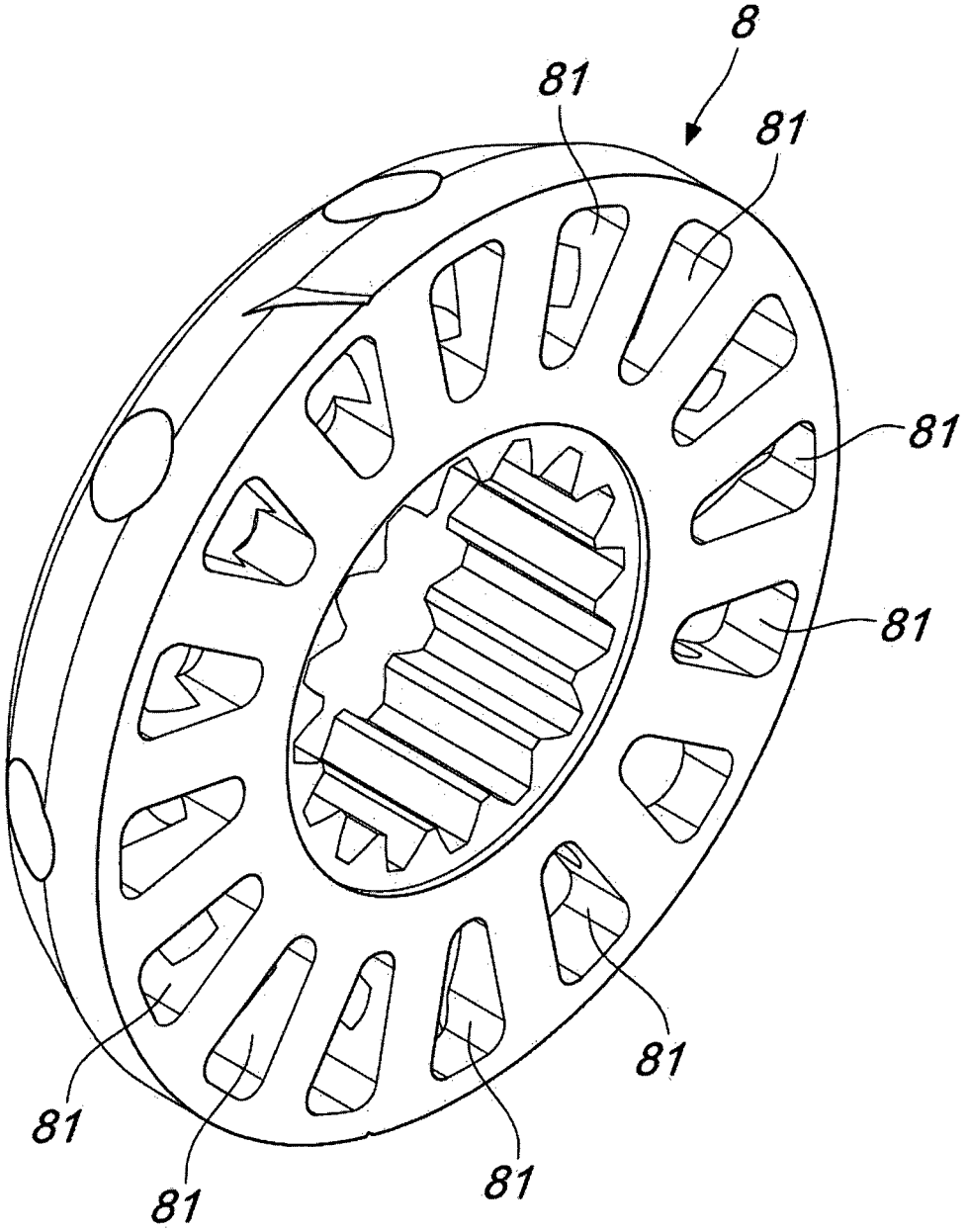
FIG. 7 illustrates a perspective view of a part of the machine of the preceding figures.

The distributor assembly comprises a rotating distributor 8 and a fixed distributor 9. The distributor assembly 8,9 is configured to send/receive a flow rate of hydraulic fluid, such as oil, to the chambers 31,51; in some aspects, the distributor 8 sends/receives oil from a chamber 31 of the first lobed disk 3 and from the latter the oil flows into the chamber 51 of the second lobed disk 5 which is in fluid communication with the first and which, with it, forms a pair defining a compartment of the machine. Although theoretically two distinct distributor assemblies could be provided, one for the chambers 31 and one for the chambers 51, as mentioned, both the chambers may be operatively connected to the same distributor assembly 8,9, thus simplifying construction. The distributor assembly 8,9 is of the type usually employed in the state of the art in hydraulic orbital machines, and should therefore be considered known per se. It is in any case briefly described here in the preferred embodiment illustrated in FIGS. 1 and 7.

The rotating distributor 8 is coupled to the support shaft 72 and comprises a series of holes 81 which are alternately connected to a source of high- or low-pressure hydraulic fluid (not illustrated). In certain embodiments, the operative connection to the source of high- or low-pressure fluid, through the holes, may be alternate: if one hole is connected to the high-pressure source, the two adjacent holes—the previous one and the following one—are connected to the low pressure and vice versa. Supply of the high- or low-pressure fluid to the chambers is therefore determined by the interaction between the rotating distributor 8 and the fixed distributor 9: the former is in fact connected to the high- or low-pressure fluid sources through the fixed distributor 9 which has dedicated channels for said purpose. The supply of fluid alternately at high or low pressure to a chamber 31 is determined by the relative angular displacement determined between the rotating distributor 8 and the fixed distributor 9, so that a chamber 31 according to its angular position relative to the centre of rotation X will be alternately supplied by high- or low-pressure fluid.

The machine 1 is, in particular, a roller type orbital engine, namely in which the first and second stator case portions 2,4 comprise rolling bodies 21,41 (e.g. cylinders) configured to cooperate with the first and the second lobed disks 3,5 respectively to partly delimit the respective first and second chambers 31,51 with variable volume. In other embodiments not shown, the machine is instead of the Gerotor type, in which the rolling bodies are omitted and replaced by contoured walls of the stator case portions.

From the above it follows that the subject of the invention is also a method for adjusting a hydraulic orbital machine comprising a first stator case portion 2 which delimits a first internal contoured volume, a first lobed disk 3 configured to rotate eccentrically about a rotation axis X in the first stator case portion 2 thus defining with the latter a plurality of first chambers 31 having variable volume in the rotation of the first lobed disk 3, at least one of said first chambers having a minimum volume at a first angle of the first stator case portion 2.

According to the invention, the method comprises the following steps:

providing a second stator case portion 4 that delimits a second internal contoured volume, providing at least a second lobed disk 5 configured to rotate eccentrically together with the first lobed disk 3 about said rotation axis in the second stator case portion 4, thus defining with the latter a plurality of second chambers 51 having variable volume in the rotation of the second lobed disk 5, at least one of said second chambers having a minimum volume at a second angle of the second stator case portion 2, mutually angularly offsetting said first and second angle.

The term "adjustment" of the orbital machine here indicates an adjustment of operating parameters, such as adjustment of the power, such as the power delivered if the machine is an engine, or the power absorbed if the machine is a pump. It has been ascertained in practice that the invention achieves the predefined purpose and objects.

The invention, thus conceived, is subject to numerous modifications and variations, all falling within the scope of the inventive concept; furthermore, all the details can be replaced by other technically equivalent elements. For example, instead of only two stator case portion/lobed disk pairs, there could be three, four or more.

Again, the adjustment means 6 comprising shaft and pivot described above are only examples of a possible solution; in fact different solutions not shown comprise adjustment means 6 that allow for a different type of angular displacement, for example by means of an appropriate thread or gear provided on the lobed disk/s, an electric/hydraulic engine or an actuator acting on said thread or gear.

In practice, the materials used (provided that they are compatible with the specific use) and the dimensions and the contingent forms can be used according to requirements and the state of the art.

The invention claimed is:

1. A hydraulic orbital machine, comprising:

a first stator case portion, which delimits a first internal contoured volume; and a first lobed disk configured to rotate eccentrically about a rotation axis in the first stator case portion so as to form a plurality of first chambers which have a volume that varies with rotation of the first lobed disk, wherein at least one first chamber of the plurality of first chambers has a minimum volume at a first angle of the first stator case portion, the machine further comprising:

a second stator case portion, which delimits a second internal contoured volume;

at least one second lobed disk configured to rotate together with the first lobed disk eccentrically about the rotation axis in the second stator case portion so as to form a plurality of second chambers having a volume that varies with rotation of the at least one second lobed disk, wherein at least one second chamber of the plurality of second chambers has a minimum volume at a second angle of the second stator case portion, and adjustment means designed to mutually angularly offset the first and second angles;

wherein the first and second stator case portions comprise rolling bodies configured to directly interact with the first and second lobed disks in order to partly delimit a respective chamber of the plurality of first chambers and plurality of second chambers with variable volume.

2. The hydraulic orbital machine according to claim 1, wherein the adjustment means are connected to at least one between the first or second stator case portion, wherein the at least one between the first or second stator case portion are rotatable about the rotation axis.

3. The hydraulic orbital machine according to claim 1, wherein the first and second lobed disks are coupled to a same shaft.

4. The hydraulic orbital machine according to claim 1, wherein the machine further comprises a distribution assembly configured to send/receive a flow rate of a hydraulic fluid to the respective chambers of the plurality of first and second chambers.

5. The hydraulic orbital machine according to claim 1, wherein the machine further comprises an external enclosure of the machine, wherein the first and second stator case portions are inside the external enclosure.

6. The hydraulic orbital machine according to claim 5, wherein the adjustment means are kinematically coupled to the second stator case portion, which rotates with respect to the enclosure, the first stator case portion being fixed with respect to the enclosure.

7. The hydraulic orbital machine according to claim 5, wherein the adjustment means comprise at least one hydraulic cylinder arranged inside the external enclosure or integrated in the external enclosure.

8. The hydraulic orbital machine according to claim 5, wherein the second stator case portion has N protrusions or rolling bodies to cooperate with the second lobed disk to partially delimit the at least one second chamber with variable volume, where the second stator case portion is rotatable about the rotation axis relative to the external enclosure, and where the second stator case portion is connected to the adjustment means and where the second stator case portion is accommodated inside of the external enclosure so that the adjustment means are configured to rotate the second stator case portion relative to the external enclosure by an angle $\varphi$ with $\varphi \geq 360°/(2 \cdot N)$.

9. The hydraulic orbital machine according to claim 5, wherein the first stator case portion and the second stator case portion are accommodated inside of the external enclosure and are rotatable about the rotation axis relative to the external enclosure.

10. The hydraulic orbital machine according to claim 1, wherein the adjustment means comprise an actuation shaft coupled to a pivot which engages in a seat of the second stator case portion.

11. The hydraulic orbital machine according to claim 1, wherein the adjustment means include at least an actuation shaft configured to move in a plane perpendicular to the rotation axis.

12. The hydraulic orbital machine according to claim 1, wherein the adjustment means include a second actuation shaft connected with the first stator case portion to rotate the first stator case portion about the rotation axis, and a first actuation shaft connected with the second stator case portion to rotate the second stator case portion about the rotation axis.

13. A method for adjusting a hydraulic orbital machine comprising a first stator case portion which delimits a first internal contoured volume, a first lobed disk configured to rotate eccentrically about a rotation axis in the first stator case portion in order to form a plurality of first chambers which have a volume that varies in the rotation of the first lobed disk, at least one of the first chambers having a minimum volume at a first angle of the first stator case portion, wherein the first chambers are between the first stator case and the first lobed disk;

the method comprising the following steps:

providing a second stator case portion which delimits a second internal contoured volume;

providing at least one second lobed disk configured to rotate together with the first lobed disk eccentrically about the rotation axis in the second stator case portion in order to form a plurality of second chambers which have a volume that varies in the rotation of the second lobed disk, wherein the second chambers are between the second stator case and the at least one second lobed disk;

at least one of the second chambers having a minimum volume at a second angle of the second stator case portion; and mutually angularly offsetting the first and second angles.

* * * * *